US006473913B1

(12) United States Patent
Bell, Sr.

(10) Patent No.: US 6,473,913 B1
(45) Date of Patent: Nov. 5, 2002

(54) BIDET ATTACHMENT FOR A TOILET

(76) Inventor: Edmond Bell, Sr., 3140 W. Florence Ave., Los Angeles, CA (US) 90043

( * ) Notice: Subject to any disclaimer, the term of this patent is extended or adjusted under 35 U.S.C. 154(b) by 0 days.

(21) Appl. No.: 10/084,797

(22) Filed: Feb. 26, 2002

(51) Int. Cl.[7] ..... A61H 35/00
(52) U.S. Cl. ..... 4/448; 4/420.4; 4/443
(58) Field of Search ..... 4/420.1–420.4, 4/443, 447, 448, 567, 569, 570, 615; 239/583, 586

(56) References Cited

U.S. PATENT DOCUMENTS 4,926,509 A * 5/1990 Bass ..... 4/420.4
5,272,774 A * 12/1993 Ivko et al. ..... 4/420.2
5,720,055 A * 2/1998 Krist ..... 4/420.4
5,937,451 A * 8/1999 Mihara ..... 4/448

* cited by examiner

*Primary Examiner*—Steven O. Douglas
*Assistant Examiner*—Tuan Nguyen
(74) *Attorney, Agent, or Firm*—Goldstein & Lavas, P.C.

(57) ABSTRACT

A bidet attachment for a toilet having a water hose for connecting to an existing water supply pipe of that toilet. A S nozzle is connected to the water hose, having a handle, a distal portion having an end wall, and a central arc between the handle and distal end. The nozzle has a stream outlet at the end wall and a sprayer on the central arc. The handle has a stream outlet valve and a sprayer valve for selectively controlling water flow to the stream outlet and sprayer, respectively. A bracket is adhered to the side of the toilet, and has a U-shaped hook for supporting the nozzle when not in use.

5 Claims, 3 Drawing Sheets

BIDET ATTACHMENT FOR A TOILET

CROSS REFERENCES AND RELATED SUBJECT MATTER

The invention relates to subject matter contained in patent application Ser. No. 09/844,596, filed in the United States Patent Office on Apr. 27, 2001.

BACKGROUND OF THE INVENTION

The present invention relates to a bidet attachment for a toilet and more particularly pertains to allowing an individual to clean themselves after using the toilet.

The use of toilet devices and accessories is known in the prior art. More specifically, toilet devices and accessories heretofore devised and utilized for the purpose of facilitating the use of the toilet are known to consist basically of familiar, expected and obvious structural configurations, notwithstanding the myriad of designs encompassed by the crowded prior art that have been developed for the fulfillment of countless objectives and requirements.

By way of example, U.S. Pat. No. 5,295,274 to Daniels discloses a liquid dispensing device capable of being connected with existing bathroom plumbing and is capable of spraying water for sanitary purposes. U.S. Pat. No. 4,890,340 to Lovitt discloses a hand held bidet device capable of spraying water for cleaning the body.

While these devices fulfill their respective, particular objective and requirements, the aforementioned patents do not describe a bidet attachment for a toilet for allowing an individual to clean themselves after using the toilet.

In this respect, the bidet attachment for a toilet according to the present invention substantially departs from the conventional concepts and designs of the prior art, and in doing so provides an apparatus primarily developed for the purpose of allowing an individual to clean themselves after using the toilet.

Therefore, it can be appreciated that there exists a continuing need for a new and improved bidet attachment for a toilet that can be used for allowing an individual to clean them after using the toilet. In this regard, the present invention substantially fulfills this need.

SUMMARY OF THE INVENTION

In the view of the foregoing disadvantages inherent in the known types of toilet devices and accessories now present in the prior art, the present invention provides an improved bidet attachment for a toilet. As such, the general purpose of the present invention, which will be described subsequently in greater detail, is to provide a new and improved bidet attachment for a toilet that has all the advantages of the prior art and none of the disadvantages.

To attain this, the present invention essentially comprises a water housing having an inlet and a first outlet. The inlet is coupled with the existing water supply pipe. The first outlet has a pipe extending upwardly therefrom. The pipe has an open upper end. The open upper end is coupled with the water inlet of the tank of the toilet. The water housing has a second outlet. The second outlet has a valve in communication therewith. The valve has a control handle disposed on an outer surface of the water housing. A water hose extends outwardly from the second outlet of the water housing. The water hose has an open outer end. A nozzle is secured to the open outer end of the water hose. The nozzle has a stream outlet and a sprayer. The nozzle includes a stream actuation valve in communication with the stream outlet to control water flow thereto. The nozzle includes a spray actuation valve in communication with the sprayer to control water flow thereto. A bracket is secured to a side surface of the tank of an existing toilet. The bracket includes a base portion having an adhesive disposed thereon to facilitate securement to the tank. The bracket includes a U-shaped hook extending from the base portion for receiving and holding the nozzle when not in use.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bidet attachment for a toilet that has all the advantages of the prior art toilet devices and accessories and none of the disadvantages.

It is another object of the present invention to provide a new and improved bidet attachment for a toilet that may be easily and efficiently manufactured and marketed.

It is a further object of the present invention to provide a new and improved bidet attachment for a toilet that is By of durable and reliable construction.

An even further object of the present invention is to provide a new and improved bidet attachment for a toilet that is susceptible of a low cost of manufacture with regard to both materials and labor, and which accordingly is then susceptible of low prices of sale to the consuming public, thereby making such a bidet attachment for a toilet economically available to the buying public.

Even still another object of the present invention is to provide a new and improved bidet attachment for a toilet for allowing an individual to clean themselves after using the toilet, and may further be employed for other cleaning operations, such as when bathing an infant at a nearby bathtub.

Lastly, it is an object of the present invention to provide a new and improved bidet attachment for a water hose which connects to an existing water supply pipe. The water hose has an open outer end and a nozzle thereat. The nozzle has a distal end having has an openable stream outlet and a central arc having a sprayer.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
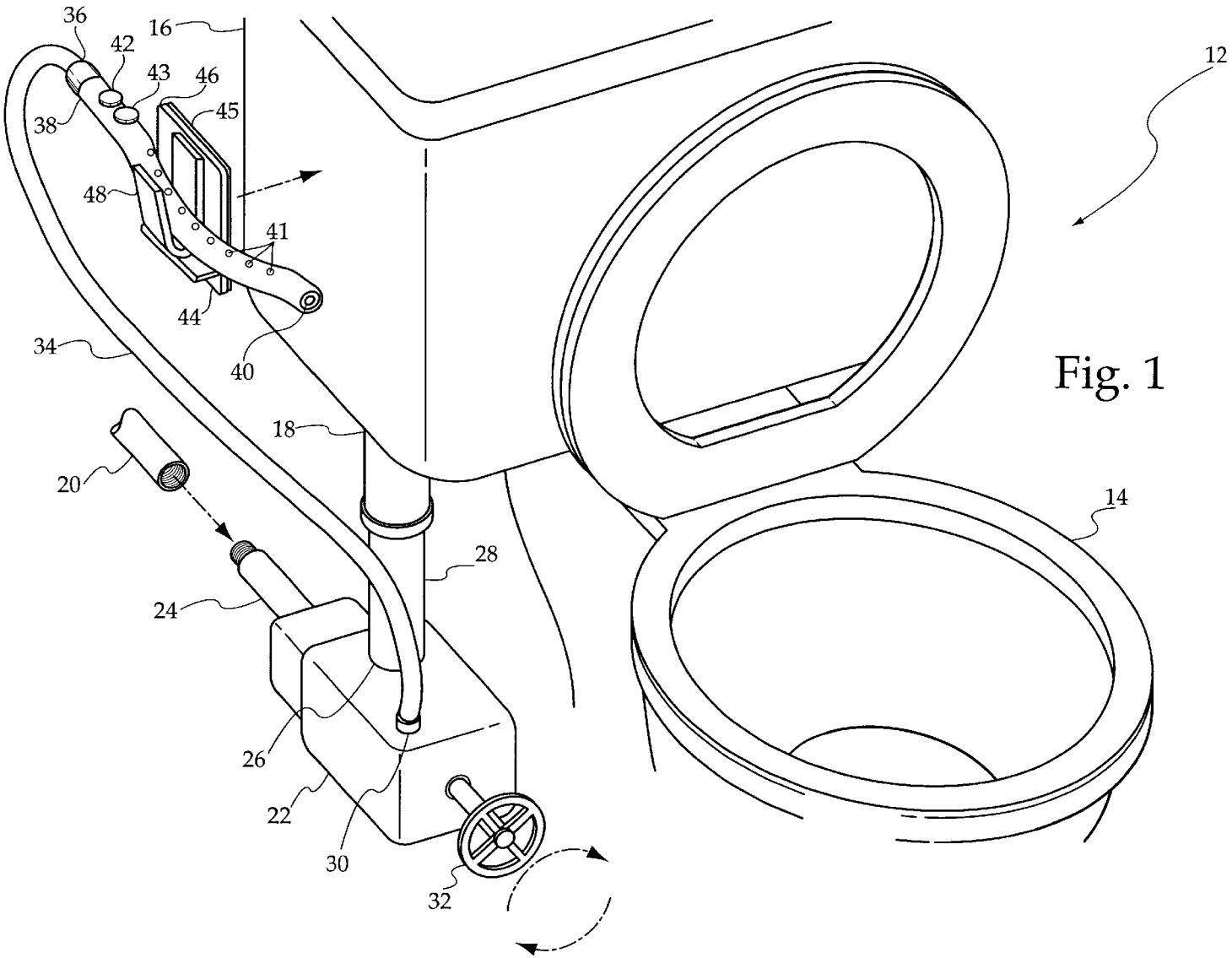
FIG. 1 is a perspective view of the preferred embodiment of the bidet attachment for a toilet constructed in accordance with the principles of the present invention.
Figure 2:
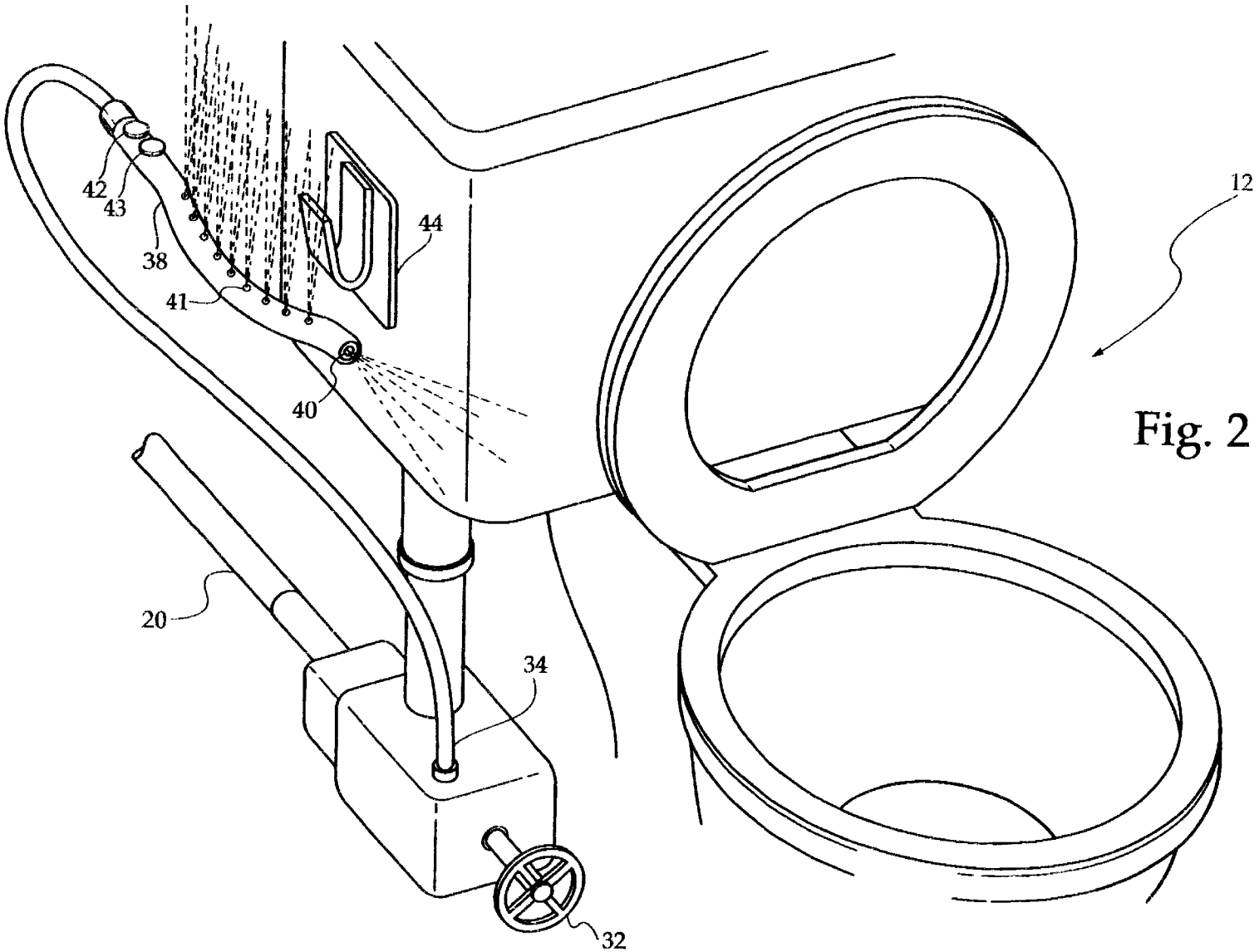
FIG. 2 is a perspective view of the present invention illustrated in use.
Figure 3:
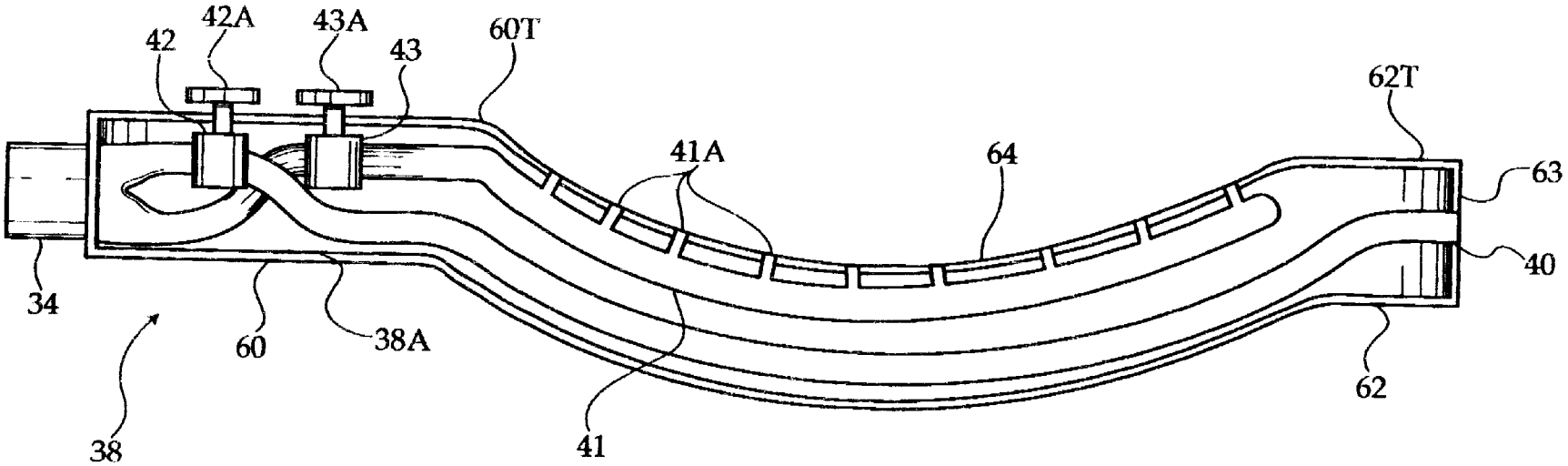
FIG. 3 is a side elevational view of the nozzle, with parts broken away, illustrating interconnection of the sprayer valve with the sprayer and the stream valve with the stream outlet.

With reference now to the drawings, and in particular, to FIGS. 1 through 3 thereof, the preferred embodiment of the new and improved bidet attachment for a toilet embodying the principles and concepts of the present invention will be described.

Specifically, it will be noted in the various figures that the device relates to a bidet attachment for a toilet for allowing an individual to clean themselves after using the toilet. In its broadest context, the device consists of a water hose coupleable with an existing water supply, a nozzle, and a bracket. Such components are individually configured and correlated with respect to each other so as to attain the desired objective.

The present invention is designed for use with an existing toilet 12. The toilet 12 includes a main body 14 and a tank 16. The tank 16 has a water inlet 18 for connecting to an existing water supply pipe 20.

The water housing 22 has an inlet 24 and a first outlet 26. The inlet 24 is coupled with the existing water supply pipe 20. The first outlet 26 has a pipe 28 extending upwardly therefrom. The pipe 28 has an open upper end. The open upper end is coupled with the water inlet 18 of the tank 16 of the toilet 12. The water housing 22 has a second outlet 30. The second outlet 30 has a shut-off valve in communication therewith. The shut-off valve has a control handle 32 disposed on an outer surface of the water housing 22 for selectively disrupting water flow from the second outlet 30 if necessary.

The water hose 34 extends outwardly from the second outlet 30 of the water housing 22. The water hose 34 has an open outer end 36 which is attached to the nozzle 38. The nozzle 38 has an openable stream outlet 40. The nozzle 38 includes a stream valve 42 in communication with the openable stream outlet 40 to selectively control water flow out through the stream outlet 40. The nozzle 38 also has a sprayer 41, and a sprayer valve 43 which selectively controls water flow out through the sprayer 41. Both the stream valve 42 and the sprayer valve 43 may be implemented in numerous ways to control water flow as desired to the stream outlet 40 and sprayer 41, respectively. In particular, a button operated valve, a thumb wheel, a trigger, or any other suitable mechanism may be employed to control the operation of said valves 42 and 43.

The bracket 44 is secured to a side surface of the tank 16 of the toilet 12. The bracket 44 includes a base portion 46 having an adhesive disposed thereon to facilitate securement to the tank 16. In particular, double sided tape 45 is preferably employed to provide a semi-permanent attachment to the side surface of the toilet tank 16. The bracket 44 includes a U-shaped hook 48 extending outward from the base portion 46. The U-shaped hook 48 selectively receives the nozzle 38 thereon when not in use, and keeps it at a convenient location for the user.

Referring to FIG. 3, the nozzle 38 has a handle 60, a distal end 62 having an end wall 63 fully opposite from the connection of the water hose 34 and nozzle 38, and a central arc 64 between the handle 60 and distal end 62. The nozzle 38 is tubular throughout, having a nozzle wall 38A, which defines a hollow interior 38, within which the water hose 34 is split to feed both the stream valve 42 and spray valve 43, which in turn feed the stream outlet 40 and the sprayer 41, respectively. The stream valve 42 and spray valve 43 are selectively operated by thumb wheels 42A and 43A, which allow the valve to be operated and left in a chosen position, so that the nozzle 38 can be manipulated freely once the stream valve 42 or spray valve 43 has been set. The handle 60 has a top surface 60T and the distal end 62 has a top surface 62T. The central arc 64 dips between the top surface 60T of the handle 60 and the top surface 62T of the distal end 62. The central arc is curved upward, concave toward the top surfaces 60T and 62T. The handle 60 and distal end 62 are substantially parallel and generally coaxial. The sprayer is disposed adjacent to the central arc 64, such that a plurality of spray holes 41A are provided and spaced along the central arc 64, to provide a wide spray pattern as depicted in FIG. 2.

Still referring to FIG. 2, the present invention utilizes the existing water supply pipe 20 that is normally connected with the toilet 12. To use, one would simply turn the control handle 32 to allow water to flow through the water hose 34 to the nozzle 38. The user would then remove the nozzle 38 from the bracket 44 and position it under his backside and operate the stream valve 42 to allow water to flow through the stream outlet 40 on their backside to provide a cleansing flow of water thereon. Alternatively, the user would activate the spray valve 43 to initiate a more gentle spray from the sprayer 41.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bidet attachment for a toilet for allowing an individual to clean themselves after using the toilet, wherein the toilet includes a main body and a tank, the tank having a water inlet for being coupled with an existing water supply pipe, the attachment comprising, in combination:

a water housing having an inlet and a first outlet, the inlet being coupled with the existing water supply pipe, the first outlet having a pipe extending upwardly therefrom, the pipe having an open upper end, the open upper end coupled with the water inlet of the tank of the toilet, the water housing having a second outlet, the second outlet having a shut-off valve in communication therewith, the shut-off valve having a control handle disposed on an outer surface of the water housing;

a water hose extending outwardly from the second outlet of the water housing, the water hose having an open outer end;

a nozzle secured to the open outer end of the water hose, the nozzle having a nozzle wall defining a hollow interior, the nozzle having a handle, a distal portion having an end wall, and a central arc between the handle and distal portion, the nozzle having a stream outlet at the end wall and a sprayer having a plurality of spray holes spaced along the central arc, the nozzle including a stream valve in communication with the stream outlet to selectively control water flow to the stream outlet; and a bracket securable to a side surface of the tank of the toilet, the bracket including a base portion having an adhesive disposed thereon to facilitate securement to the tank, the bracket including a U-shaped hook secured to the base portion, the U-shaped hook receiving the nozzle thereon when not in use.

2. A bidet attachment for a toilet for allowing an individual to clean themselves after using the toilet, wherein the toilet includes a main body and a tank, the tank having a water inlet for being coupled with an existing water supply pipe, the attachment comprising, in combination:

a water hose for connecting to the existing water supply pipe and having an open outer end;

a nozzle secured to the open outer end of the water hose, the nozzle having a nozzle wall defining a hollow interior, the nozzle having a handle having a top surface, a distal portion having an end wall, and a central arc between the handle and distal portion, the nozzle having a stream outlet at the end wall and a sprayer having a plurality of spray holes spaced along the central arc, the nozzle including a stream valve on the handle in communication with the stream outlet to selectively control water flow to the stream outlet and a spray valve on the handle in communication with the sprayer to selectively control water flow to the sprayer.

3. The bidet attachment for a toilet as set forth in claim two, further comprising a bracket securable to a side surface of the tank of the toilet, the bracket including a base portion having an adhesive disposed thereon to facilitate securement to the tank, the bracket including a U-shaped hook secured to the base portion, the U-shaped hook receiving the nozzle thereon when not in use.

4. The bidet attachment for a toilet as set forth in claim three, wherein the spray valve and stream valve each have a thumb wheel extending above the top surface of the handle, to allow the spray valve and stream valve to be operated and set by the user.

5. The bidet attachment for a toilet as set forth in claim four, wherein the distal end has a distal end top, and wherein the handle and distal end extend substantially parallel and coaxial, and the central arc is concave toward the handle top and distal end top.

* * * * *